US009079095B2

(12) United States Patent
Mangold et al.

(10) Patent No.: US 9,079,095 B2
(45) Date of Patent: Jul. 14, 2015

(54) HEEL RETAINER WITH ROLLER-SHAPED SOLE RETAINER

(71) Applicant: MARKER Deutschland GmbH, Penzberg (DE)

(72) Inventors: Michael Mangold, Grainau (DE); Christian Brandl, Garmisch-Partenkirchen (DE)

(73) Assignee: Marker Deutschland GmbH, Penzberg (DE)

( * ) Notice: Subject to any disclaimer, the term of this patent is extended or adjusted under 35 U.S.C. 154(b) by 0 days.

(21) Appl. No.: 14/170,698

(22) Filed: Feb. 3, 2014

(65) Prior Publication Data

US 2014/0217704 A1 Aug. 7, 2014

(51) Int. Cl.

| | |
|---|---|
| ***A63C 9/084*** | (2012.01) |
| ***A63C 9/24*** | (2012.01) |
| ***A63C 9/00*** | (2012.01) |
| ***A63C 9/08*** | (2012.01) |

(52) U.S. Cl.

CPC . *A63C 9/24* (2013.01); *A63C 9/001* (2013.01); *A63C 9/0807* (2013.01); *A63C 9/0844* (2013.01); *A63C 9/0845* (2013.01)

(58) Field of Classification Search

CPC ..... A63C 9/082; A63C 9/084; A63C 9/085
USPC ..... 280/616, 617, 629, 634
See application file for complete search history.

(56) References Cited

U.S. PATENT DOCUMENTS

| | | | | | |
|---|---|---|---|---|---|
| 3,630,537 | A | * | 12/1971 | Brunner | 280/616 |
| 3,863,941 | A | | 2/1975 | Hausleithner | |
| 3,873,112 | A | | 3/1975 | Covini | |
| 3,910,591 | A | * | 10/1975 | Salomon | 280/613 |
| 4,401,318 | A | * | 8/1983 | Beyl | 280/630 |
| 4,505,493 | A | * | 3/1985 | Gustavsson | 280/617 |
| 4,607,859 | A | * | 8/1986 | Wittmann et al. | 280/632 |
| 4,615,536 | A | * | 10/1986 | Stritzl et al. | 280/631 |
| 4,629,209 | A | * | 12/1986 | Lorenz et al. | 280/626 |
| 4,657,277 | A | * | 4/1987 | Haldemann et al. | 280/616 |
| 4,693,489 | A | * | 9/1987 | Stepanek et al. | 280/634 |

(Continued)

FOREIGN PATENT DOCUMENTS

| | | |
|---|---|---|
| FR | 2.195.467 | 3/1974 |
| FR | 2.717.041 | 9/1974 |
| FR | 2 909 564 | 6/2008 |

OTHER PUBLICATIONS

European Search Report issued in EP 14 15 3046 dated May 26, 2014.

*Primary Examiner* — Jeffrey J Restifo

(74) *Attorney, Agent, or Firm* — RatnerPrestia

(57) ABSTRACT

A heel retainer for a ski binding, includes a base plate using which the heel retainer can be fastened to an upper side of a ski or snowboard; a connecting structure connectable to the base plate; and a tensioning device using which a ski boot is tensioned onto the ski. The connecting structure includes first and second connecting structure parts. The first connecting structure part can be moved relative to the second connecting structure part in the transverse release direction when the ski binding is transversely released. The tensioning device includes a sole retainer which, in direct contact with the sole of a ski boot, tensions the ski boot onto the ski or snowboard. The sole retainer is formed as a rolling body exhibiting a rotational axis and is connected to the tensioning device such that the sole retainer can be rotated about its rotational axis.

21 Claims, 3 Drawing Sheets

(56) References Cited

U.S. PATENT DOCUMENTS

| | | | | | |
|---|---|---|---|---|---|
| 4,765,641 | A | * | 8/1988 | Peyre | 280/628 |
| 4,858,946 | A | * | 8/1989 | Stritzl et al. | 280/618 |
| 4,867,471 | A | * | 9/1989 | Stritzl et al. | 280/618 |
| 4,889,359 | A | * | 12/1989 | Kowatsch et al. | 280/629 |
| 4,892,326 | A | * | 1/1990 | Svoboda et al. | 280/618 |
| 4,989,893 | A | * | 2/1991 | Kowatsch et al. | 280/625 |
| 5,020,823 | A | * | 6/1991 | Bogner | 280/634 |
| 5,024,457 | A | * | 6/1991 | Bogner | 280/632 |
| 5,056,808 | A | * | 10/1991 | Klaus et al. | 280/617 |
| 5,094,471 | A | * | 3/1992 | Luschnig et al. | 280/628 |
| 5,096,218 | A | * | 3/1992 | Bardin | 280/633 |
| 5,131,675 | A | * | 7/1992 | Haldemann et al. | 280/617 |
| 5,213,357 | A | * | 5/1993 | Gorza et al. | 280/607 |
| 5,213,358 | A | * | 5/1993 | Badura | 280/612 |
| 5,222,756 | A | * | 6/1993 | Gorza | 280/616 |
| 5,228,715 | A | * | 7/1993 | Sedlmair | 280/620 |
| 5,326,127 | A | * | 7/1994 | Mercat et al. | 280/632 |
| 5,527,058 | A | * | 6/1996 | Janisch et al. | 280/634 |
| 5,566,966 | A | * | 10/1996 | Couderc et al. | 280/602 |
| 5,575,496 | A | * | 11/1996 | Luitz et al. | 280/618 |
| 5,687,982 | A | * | 11/1997 | Challande et al. | 280/607 |
| 5,713,593 | A | * | 2/1998 | Renaud-Goud et al. | 280/607 |
| 5,735,541 | A | * | 4/1998 | Fritschi et al. | 280/617 |
| 6,092,831 | A | * | 7/2000 | Bauvois | 280/625 |
| 6,296,267 | B1 | * | 10/2001 | Buquet | 280/626 |
| 6,375,212 | B1 | * | 4/2002 | Hillairet et al. | 280/617 |
| 6,585,282 | B2 | * | 7/2003 | Merino et al. | 280/634 |
| 6,588,791 | B1 | * | 7/2003 | Horn | 280/613 |
| 7,100,938 | B2 | * | 9/2006 | Krumbeck et al. | 280/611 |
| 7,267,356 | B2 | * | 9/2007 | Buquet et al. | 280/616 |
| 7,306,256 | B2 | * | 12/2007 | Walker et al. | 280/614 |
| 7,320,476 | B2 | * | 1/2008 | Haldemann | 280/628 |
| 7,357,406 | B2 | * | 4/2008 | Krumbeck et al. | 280/611 |
| 7,431,323 | B2 | * | 10/2008 | Holzer et al. | 280/625 |
| 7,874,591 | B2 | * | 1/2011 | Korich | 280/809 |
| 8,579,317 | B2 | * | 11/2013 | Merino et al. | 280/611 |
| 2014/0217704 | A1 | * | 8/2014 | Mangold et al. | 280/634 |

* cited by examiner

HEEL RETAINER WITH ROLLER-SHAPED SOLE RETAINER

CROSS REFERENCE TO RELATED APPLICATIONS

This application claims priority to German Patent Application No. 10 2013 201 727.8, filed Feb. 1, 2013, the contents of such application being incorporated by reference herein.

FIELD OF THE INVENTION

The invention relates to a heel retainer for a ski binding, comprising: a base plate using which the heel retainer can be fastened on a ski or snowboard; a connecting structure which can be connected to the base plate; and a tensioning device using which a ski boot is tensioned onto the ski or snowboard. The tensioning device comprises a horizontal pivoting axis, wherein the tensioning device is or can be connected to the connecting structure such that it can be pivoted in the pivoting joint. The tensioning device comprises a sole retainer which, in direct contact with the sole of a ski boot, tensions the ski boot onto the ski and assists the release movement of the ski boot when the binding is transversely released.

SUMMARY OF THE INVENTION

An aspect of the invention provides a heel retainer which reliably transversely releases the ski binding when a transverse release force, which preferably can be set, is exceeded. Another aspect provides a tensioning device for the heel retainer, a sole retainer for the heel retainer and a ski or snowboard comprising a safety binding which includes the heel retainer.

An aspect of the invention relates to a heel retainer for a ski binding, comprising a base plate using which the heel retainer can be connected to the surface of a ski or snowboard; a connecting structure which can be connected to the base plate; and a tensioning device using which a ski boot is tensioned onto the ski.

The base plate is a base structure which is or can be fixedly connected to the ski, for example integrated into the surface of the ski. The base structure can consist of one piece and serve to connect a toe retainer and the heel retainer to the ski. The base structure can alternatively comprise at least two parts, one of which connects the toe retainer to the ski and another of which connects the heel retainer to the ski.

The connecting structure comprises a first connecting structure part and a second connecting structure part, wherein the first connecting structure part can be moved relative to the second connecting structure part in the transverse release direction when the ski binding is transversely released. The first connecting structure part can be translationally moved, transversely offset, or preferably rotationally pivoted, i.e. rotated or pivoted, relative to the second connecting structure part, wherein a guide rail or linkage which can be formed on or in the second connecting structure part determines the degree of freedom of the relative movement between the two connecting structure parts. The guide rail can thus for example be formed such that when the first connecting structure part is moved relative to the second connecting structure part, it is simultaneously moved away from the surface of the ski.

The tensioning device comprises a sole retainer in the form of at least one rolling body which, in direct contact with the sole of a ski boot, tensions the ski boot onto the ski or snowboard, wherein the at least one rolling body exhibits a rotational axis and is connected to the tensioning device such that it can rotate about its rotational axis.

The rotational axis of the rolling body can be perpendicular to the surface of the ski or at an angle which is more than 0° and less than 90°. The rotational axis is preferably at an acute angle to the surface of the ski, wherein the angle is inclined towards a rear end of the ski boot, thus forming a triangle of forces which acts on the sole of the ski boot, comprising a large force vector which presses the ski boot towards the surface of the ski, and a smaller force vector which presses the ski boot in the skiing direction.

In order to hold the ski boot on a snowboard or a downhill ski or a combined downhill and touring ski in the travelling position, the tensioning device tensions the ski boot onto the ski or snowboard. In order to reduce the risk of a complicated fracture, safety bindings can provide for the binding to be transversely released when a transverse force, which preferably can be predefined, is exceeded. In order to reliably ensure that the binding is transversely released at the transverse release force, which preferably can be set, the heel retainer comprises a sole retainer in the form of a rolling body which is connected to the tensioning device such that the sole retainer and/or rolling body can rotate about its central rotational axis when it is connected to the tensioning device, and thus rolls off on the sole of the ski boot when the binding is transversely released.

The heel retainer can also comprise a foot plate which is embodied as a sliding plate and can be moved in a direction transverse to the longitudinal direction of the ski binding, such that it can move in the release direction when the binding is transversely released.

The sole retainer is formed by at least one rolling body, preferably two or more rolling bodies, each of which is individually connected to the tensioning device body such that it can be rotated about its rotational axis.

In order to accommodate the rolling body or bodies which form(s) the sole retainer, the tensioning device body can comprise fork-shaped accommodating arms, wherein the rolling body or bodies which form(s) the sole retainer is/are preferably arranged between the upper and lower accommodating arm of the tensioning device body.

The rolling body, which is used in the following as an example of the sole retainer, can have a rotationally symmetrical shape, for example the shape of a roller, barrel, disc, sphere or partial sphere, or a body which exhibits such a geometrical shape. The rolling body can comprise a spherical bearing, barrel-shaped bearing or needle bearing which includes a rotatable outer ring, or can itself be at least partially formed by parts of such a bearing or by such a bearing.

If the rolling body is itself formed as a rotary bearing, it can comprise a central body of the bearing which is non-rotationally connected to the tensioning device and/or accommodating arm or to the upper accommodating arm and the lower accommodating arm and comprises a rotatable outer ring or race which surrounds the central body of the bearing on a flank which points transverse to the rotational direction of the rolling body. The spheres, barrels or needles which form the bearing bodies are trapped between an outer side of the flank of the central body of the bearing and an inner side of the race and form the rolling body and/or sole retainer together with the race and the central body of the bearing.

Alternatively, the rolling body can be mounted on a shaft which protrudes through the upper accommodating arm and the lower accommodating arm and the rolling body, wherein in this case, the bearing is formed between the shaft and the rolling body in the region in which the shaft protrudes through the rolling body, such that the rolling body can rotate about the shaft. In order to prevent the rolling body from then directly abutting the upper and/or lower accommodating arm, spacers which can be arranged between the upper and lower accommodating arms and the upper and/or lower side of the rolling body allow the rolling body to rotate freely about the shaft, without the free rotation being impeded by frictional forces at the points of contact between the lower and upper accommodating arms and the upper and/or lower side of the rolling body. The spacer can comprise a spring element, such that the rolling body can minimally tilt and/or move upwards and/or downwards. This can achieve a damping effect during travelling, when impacts which act on the ski are transmitted to the ski boot.

The rolling body and/or race and/or sole retainer can comprise a coating or sheathing made of a plastic or a light metal. The material is preferably chosen such that a frictional resistance between the sole of the ski boot and the coating or sheathing is reduced, such that when the binding is transversely released, wherein the rolling body and/or outer ring with a/no coating or sheathing rolls off on the sole of the ski boot, the transverse release force of the binding which is set corresponds substantially to the transverse release force which actually occurs, due to the eliminated or at least reduced friction between the rolling body and the sole of the ski boot.

The coating and/or sheathing can also exhibit elastic properties, such that the rolling body and/or coating or sheathing can optimally adapt to a surface of the sole of the ski boot in the region in which the rolling body tensions the ski boot onto the ski, wherein these elastic properties should not counteract the positive effect of the sole retainer rolling off on the sole of the ski boot and the consequently reduced friction.

In accordance with another aspect, the invention also comprises a tensioning device for a heel retainer of a combined downhill and touring binding or of a purely downhill binding, comprising a connecting element for connecting the sole retainer to the tensioning device or to an accommodating arm of the tensioning device, wherein the sole retainer or the connecting element comprises a spherical bearing, barrel-shaped bearing or needle bearing, such that the sole retainer can rotate about the connecting element, or a race of the sole retainer can rotate about a central body of the sole retainer which is non-rotationally connected to the connecting element. The sole retainer is preferably the rolling body already described further above.

In accordance with another aspect, the invention also relates to a sole retainer for a ski boot retaining element, which is designed to be connected to a tensioning device of the ski boot retaining element, preferably a tensioning device of a heel retainer of a ski binding. The sole retainer comprises a spherical bearing, barrel-shaped bearing or needle bearing, such that the sole retainer can rotate about a connecting element which can be connected to the tensioning device body. Alternatively, the sole retainer itself forms a rotary bearing together with a central body of the bearing which can be non-rotationally connected to a connecting element, and a race which forms the flank of the sole retainer which points transverse to the rotational axis of the rolling body and can rotate about the central body of the bearing. The sole retainer is preferably the rolling body described above.

In accordance with another aspect, the invention likewise comprises a ski comprising a heel retainer which includes the sole retainer described above.

BRIEF DESCRIPTION OF THE DRAWINGS

In the following, an example embodiment is described in more detail on the basis of figures.

The invention is not limited to the example embodiment shown. Features and combinations of features which are essential to the invention and which are only evident from the figures form part of the scope of the invention and can advantageously develop the invention, individually or in the combinations shown. Specifically, the figures show.

DETAILED DESCRIPTION OF THE INVENTION

Figure 1:
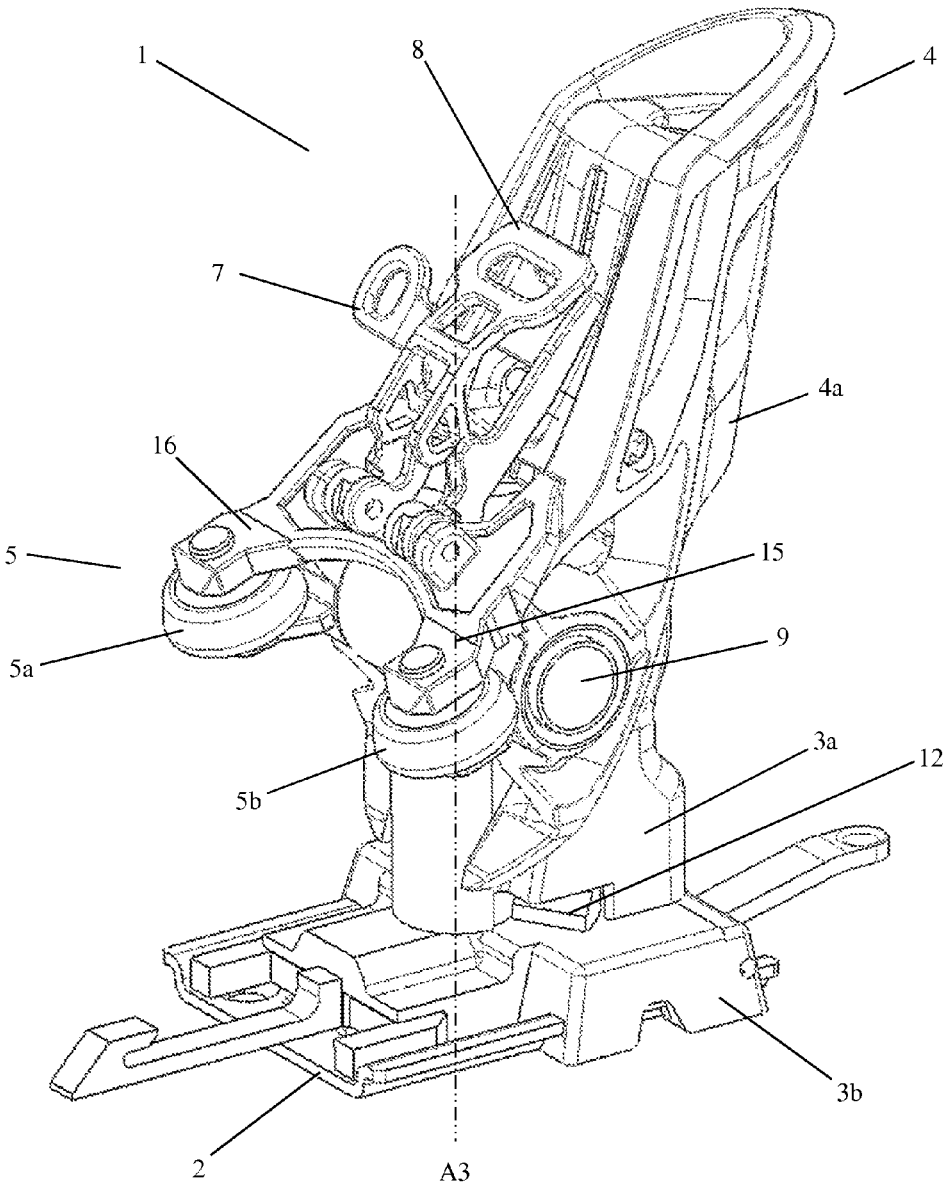
FIG. 1 a heel retainer comprising a sole retainer in accordance with the invention, in a perspective view.

FIG. 1 shows an embodiment of a heel retainer 1 of a ski binding, comprising a base plate 2 which can be fixedly connected to the ski and which determines the position of the heel retainer on the ski and relative to a toe retainer (not shown).

The heel retainer 1 comprises a connecting structure 3, which is connected to the base plate 2, and a tensioning device 4 comprising a tensioning device body 4*a*. Two climbing aids 7, 8 are fastened to the tensioning device 4, which is connected to the connecting structure 3 such that it can be pivoted in a pivoting axis 9.

The connecting structure 3 comprises a first connecting structure part 3*a* and a second connecting structure part 3*b* which are connected to each other such that they can be pivoted about the axis A3, such that when large lateral forces occur, the binding and/or the heel retainer 1 can release the ski boot by pivoting the connecting structure part 3*a* relative to the connecting structure part 3*b* about the pivoting axis A3. For setting the transverse release force, the heel retainer 1 comprises a release device (not visible), the release force of which is partly predefined by a linkage 12.

The tensioning device 4 comprises a sole retainer 5 which in the example embodiment consists of two partial sole retainers 5*a* and 5*b*. Each of the partial sole retainers 5*a*, 5*b* is embodied as a rolling body 5*a*, 5*b* in the form of a roller or disc and is mounted in accommodating arms 15, 16 formed by the tensioning device body 4*a*.

Figure 2:
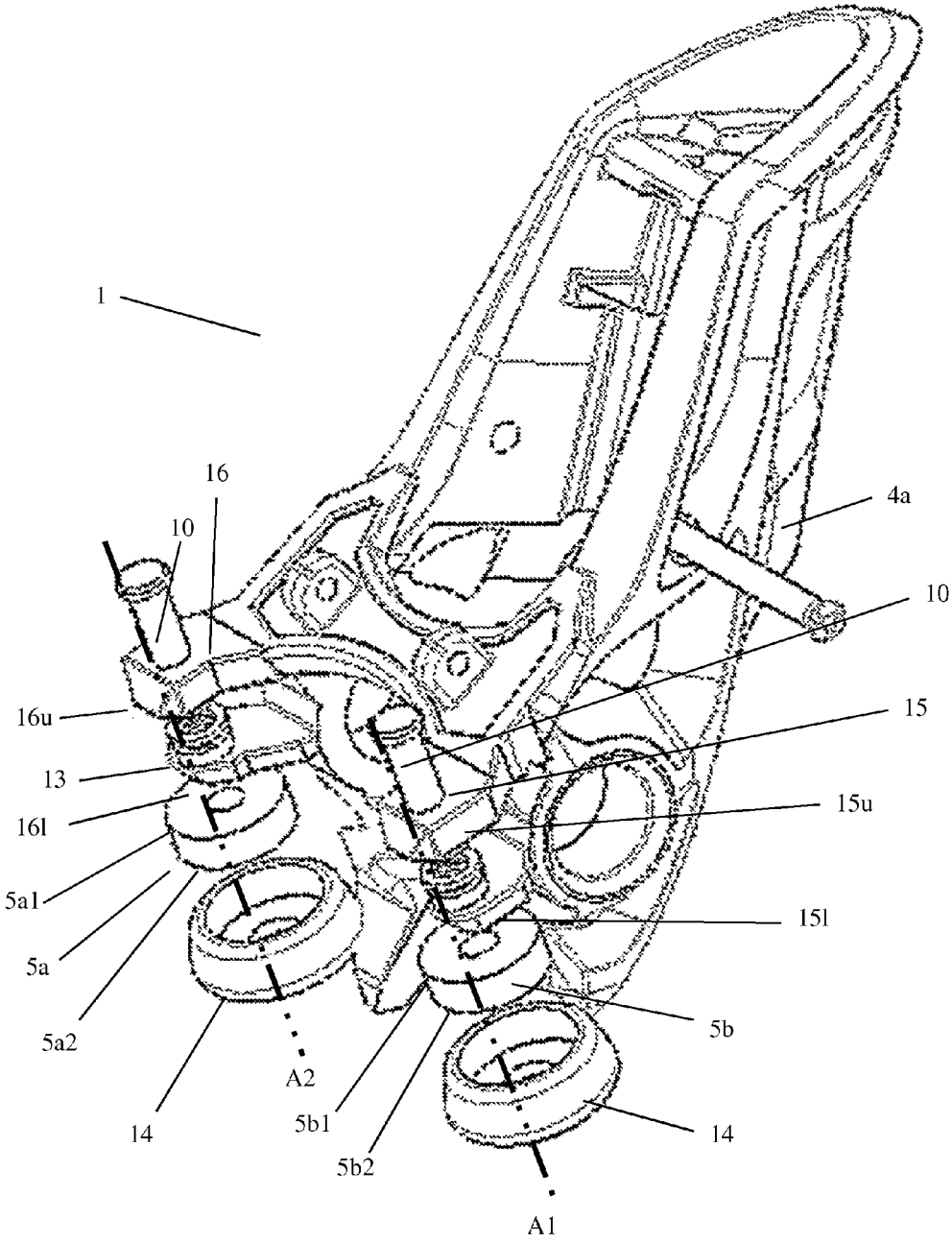
FIG. 2 an exploded drawing of a tensioning device comprising a sole retainer in accordance with the invention.

FIG. 2 specifically shows the design of the sole retainer 5 of the heel retainer 1 of FIG. 1. The tensioning device body 4*a* is shown in an enlargement. The front end of the tensioning device body 4*a* in the skiing direction comprises a sole retainer 5 which consists of two partial sole retainers 5*a*, 5*b*. Each partial sole retainer 5*a*, 5*b* is mounted in an accommodating arm 15, 16 which in the example embodiment is formed in one piece with the skeletal tensioning device body 4*a*. In the example, the accommodating arm 15, 16 comprises an upper accommodating arm 15*u*, 16*u* and a lower accommodating arm 15*l*, 16*l*.

At the end away from the tensioning device body 4*a*, the upper accommodating arms 15*u*, 16*u* and the lower accommodating arms 15*l*, 16*l* each comprise a bore, preferably a transit bore, into which a pin 10 can be inserted from above. The pin 10 can likewise protrude through a spacer 13 which can be seen below the upper accommodating arm 15*u*, 16*u*. In the example embodiment, the spacer is embodied as a spring element 13 or at least comprises a spring element 13. An identical spacer can also be provided above the lower accommodating arm 15*l*, 16*l*, but cannot be seen in FIG. 2. The pin 10 also protrudes through the rolling body 5*a*, 5*b* and holds it in the position shown in FIG. 1 between the upper accommodating arm 15*u*, 16*u* and the lower accommodating arm 15*l*, 16*l*.

In the example embodiment, the rolling body 5*a*, 5*b* is a disc-like body which, when installed, can rotate about its rotational axis A1 or A2, respectively, and so roll off on the sole of the ski boot when the heel retainer 1 is laterally released, thus at least reducing a frictional resistance between the sole of the ski boot and the sole retainer 5 when the heel retainer 1 is transversely released.

In order for the rolling body 5*a*, 5*b* to be able to rotate about its rotational axis A1, A2, the pin 10 or the rolling body 5*a*, 5*b* can comprise a rotary bearing, for example a spherical bearing, barrel-shaped bearing or needle bearing, in the region in which the pin 10 protrudes through the rolling body 5*a*, 5*b*, wherein the rotary bearing is for example formed on or in the rolling body 5*a*, 5*b* on the inner circumference of the transit opening or on the pin 10 on the outer circumference in the region in which the pin 10 protrudes through the rolling body 5*a*, 5*b*.

Alternatively, the rolling body 5*a*, 5*b* can also comprise a central body 5*a*1, 5*b*1 of the bearing and a race 5*a*2, 5*b*2 which is non-detachably connected to the central body 5*a*1, 5*b*1 of the bearing and forms the outer circumference of the rolling body 5*a*, 5*b*. In this alternative embodiment, the central body 5*a*1, 5*b*1 of the bearing is connected to the pin 10 such that the central body 5*a*1, 5*b*1 of the bearing cannot rotate relative to the pin 10 about the rotational axis A1, A2. In this embodiment, the rotation about the rotational axis A1, A2 occurs between the stationary central body 5*a*1, 5*b*1 of the bearing and the race 5*a*2, 5*b*2 which can be rotated about the central body 5*a*1, 5*b*1 of the bearing. In this alternative embodiment, the pin 10 can merely engage with the central body 5*a*1, 5*b*1 of the bearing and need not protrude through it.

It is likewise possible to omit the lower accommodating arm 15*l*, 16*l* and the spacer or spacers 13, which—in particular when using the heel retainer 1 in children's bindings—can lead to a reduction in weight and cost.

The result of the alternative embodiments described is identical: in all cases, the rolling body 5*a*, 5*b* can roll off on the sole of the ski boot when the ski binding and/or heel retainer 1 is transversely released.

The rolling body 5*a*, 5*b* can comprise a sheathing 14 which consists of a material which further reduces a rolling resistance between the rolling body 5*a*, 5*b* and the sole of the ski boot and/or which is elastic, in order to optimally adapt to a shape of the sole of the ski boot in the engagement region. This material can be a plastic or a light metal.

The sheathing 14 can be connected to the rolling body 5*a*, 5*b* such that the sheathing 14 can easily be swapped by the user. The user can then for example select the color or design of the sheathing 14 at will and change the optical appearance of the heel retainer 1 at will by swapping it.

Figure 3:
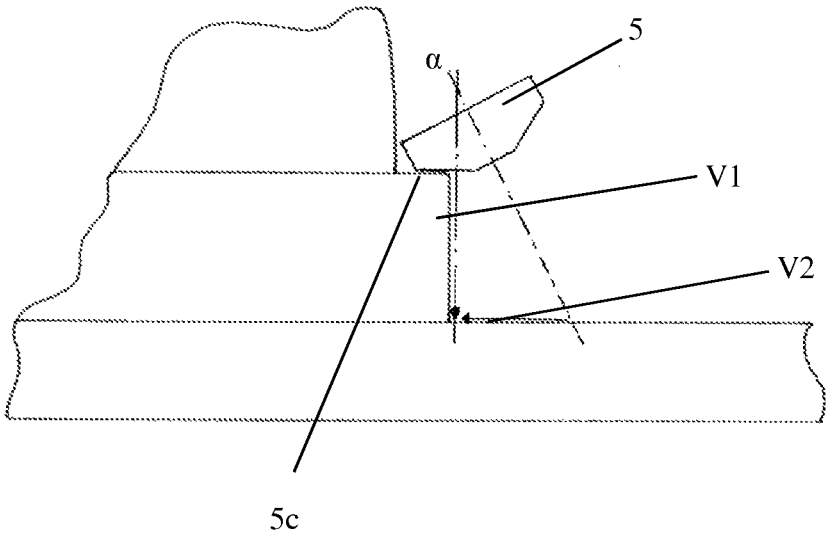
FIG. 3 a sketch comprising a sole retainer in a holding engagement on the sole of a ski boot.

FIG. 3 shows a sketch of a sole retainer 5 in a holding engagement with the rear end of the sole of a ski boot. The rotational axis A1 is at an acute angle α to the surface of the ski. In the example embodiment shown, the rolling body 5*a* comprises a bearing region 5*c* via which it lies on the sole of the ski boot over an area in the holding position shown. This forms a triangle of forces comprising a force vector V1, which represents the force with which the ski boot is pressed towards the surface of the ski, and a force vector V2 which represents the force with which the ski boot is pressed in the direction of travel of the ski. If the angle α is acute, the force vector V1 is always greater than the force vector V2.

LIST OF REFERENCE SIGNS

1 heel retainer
2 base plate
3 connecting structure
3*a* connecting structure part
3*b* connecting structure part
4 tensioning device
4*a* tensioning device body
5 sole retainer
5*a* partial sole retainer, rolling body
5*a*1 central body of the bearing
5*a*2 race
5*b* partial sole retainer, rolling body
5*b*1 central body of the bearing
5*b*2 race
5*c* bearing region
6
7 climbing aid
8 climbing aid
9 pivoting axis
10 pin
11
12 linkage
13 spacer, spring element
14 sheathing
15 accommodating arm
15*u* upper accommodating arm
15*l* lower accommodating arm
16 accommodating arm
16*u* upper accommodating arm
16*l* lower accommodating arm
A1 rotational axis
A2 rotational axis
A3 pivoting axis
V1 vector
V2 vector
α angle

We claim:

1. A heel retainer for a ski binding, comprising:

a base plate using which the heel retainer can be fastened to an upper side of a ski or snowboard;

a connecting structure which can be connected to the base plate; and a tensioning device using which a ski boot is tensioned onto the ski, wherein the connecting structure comprises a first connecting structure part and a second connecting structure part, and the first connecting structure part can be moved relative to the second connecting structure part in the transverse release direction when the ski binding is transversely released, and the tensioning device comprises a sole retainer which, in direct contact with the sole of a ski boot, tensions the ski boot onto the ski or snowboard, wherein the sole retainer is formed as a rolling body exhibiting a rotational axis (A1, A2) and is connected to the tensioning device such that the sole retainer can be rotated about its rotational axis (A1, A2), and wherein the sole retainer itself forms a rotary bearing comprising a central body of the bearing which is non-rotationally connected to the tensioning device and a race which forms the flank of the sole retainer which points transverse to the rotational axis and can be rotated about the central body of the bearing.

2. The heel retainer according to claim 1, wherein the sole retainer comprises at least two rolling bodies which together form the sole retainer.

3. The heel retainer according to claim 2, wherein the sole retainer has a rotationally symmetrical shape.

4. The heel retainer according to claim 1, wherein a rotary bearing for the sole retainer is a spherical bearing, barrel-shaped bearing or needle bearing.

5. The heel retainer according to claim 1, wherein the sole retainer is connected to the tensioning device by a pin which protrudes through the sole retainer in a central opening, and a rotary bearing is formed between the pin and the inner surface of the central opening of the sole retainer.

6. The heel retainer according to claim 1, wherein the sole retainer or the race of the sole retainer comprises a coating or sheathing made of plastic or light metal.

7. A tensioning device for a heel retainer of a ski binding or snowboard binding, wherein the tensioning device comprises a sole retainer in the form of a rolling body which is formed in accordance with claim 1.

8. A sole retainer for a tensioning device in the form of a rolling body for a ski boot retaining element, wherein the sole retainer is designed to be connected to a tensioning device body, and wherein the sole retainer is formed in accordance with claim 1.

9. A ski or snowboard comprising a safety binding, wherein the safety binding comprises a heel retainer which includes a sole retainer according to claim 1.

10. A heel retainer for a ski binding, comprising:

a base plate using which the heel retainer can be fastened to an upper side of a ski or snowboard;

a connecting structure which can be connected to the base plate; and a tensioning device using which a ski boot is tensioned onto the ski, wherein the connecting structure comprises a first connecting structure part and a second connecting structure part, and the first connecting structure part can be moved relative to the second connecting structure part in the transverse release direction when the ski binding is transversely released, and the tensioning device comprises a sole retainer which, in direct contact with the sole of a ski boot, tensions the ski boot onto the ski or snowboard, wherein the sole retainer is formed as a rolling body exhibiting a rotational axis (A1, A2) and is connected to the tensioning device such that the sole retainer can be rotated about its rotational axis (A1, A2), and wherein the sole retainer comprises a coating or sheathing made of plastic or light metal.

11. The heel retainer according to claim 10, wherein the sole retainer itself forms a rotary bearing comprising a central body of the bearing which is non-rotationally connected to the tensioning device and a race which forms the flank of the sole retainer which points transverse to the rotational axis and can be rotated about the central body of the bearing.

12. A ski or snowboard comprising a safety binding, wherein the safety binding comprises a heel retainer which includes a sole retainer according to claim 10.

13. A sole retainer for a tensioning device in the form of a rolling body for a ski boot retaining element, wherein the sole retainer is designed to be connected to a tensioning device body, and wherein the sole retainer is formed in accordance with claim 10.

14. The heel retainer according to claim 10, wherein the sole retainer comprises at least two rolling bodies which together form the sole retainer.

15. A heel retainer for a ski binding, comprising:

a base plate using which the heel retainer can be fastened to an upper side of a ski or snowboard;

a connecting structure which can be connected to the base plate; and a tensioning device using which a ski boot is tensioned onto the ski, wherein the connecting structure comprises a first connecting structure part and a second connecting structure part, and the first connecting structure part can be moved relative to the second connecting structure part in the transverse release direction when the ski binding is transversely released, and the tensioning device comprises a sole retainer which, in direct contact with the sole of a ski boot, tensions the ski boot onto the ski or snowboard, wherein the sole retainer is formed as a rolling body exhibiting a rotational axis (A1, A2) and is connected to the tensioning device such that the sole retainer can be rotated about its rotational axis (A1, A2) and wherein the rotational axis (A1, A2) is at an accurate angle to the surface of the ski, wherein the angle is inclined towards a rear end of the ski boot.

16. The heel retainer according to claim 15, wherein the angle is inclined towards a rear end of the ski boot.

17. The heel retainer according to claim 15, wherein the sole retainer itself forms a rotary bearing comprising a central body of the bearing which is non-rotationally connected to the tensioning device and a race which forms the flank of the sole retainer which points transverse to the rotational axis and can be rotated about the central body of the bearing.

18. The heel retainer according to claim 15, wherein the sole retainer or a race of the sole retainer comprises a coating or sheathing made of plastic or light metal.

19. A ski or snowboard comprising a safety binding, wherein the safety binding comprises a heel retainer which includes a sole retainer according to claim 15.

20. A sole retainer for a tensioning device in the form of a rolling body for a ski boot retaining element, wherein the sole retainer is designed to be connected to a tensioning device body, and wherein the sole retainer is formed in accordance with claim 15.

21. The heel retainer according to claim 15, wherein the sole retainer comprises at least two rolling bodies which together form the sole retainer.

* * * * *

UNITED STATES PATENT AND TRADEMARK OFFICE

CERTIFICATE OF CORRECTION

PATENT NO. : 9,079,095 B2
APPLICATION NO. : 14/170698
DATED : July 14, 2015
INVENTOR(S) : Michael Mangold and Christian Brandl It is certified that error appears in the above-identified patent and that said Letters Patent is hereby corrected as shown below:

On the Title Page, insert item -- (30) Foreign Application Priority Data
Feb. 1, 2013 (DE)...10 2013 201 727.8 --

On the Title Page, item (56) References Cited, FOREIGN PATENT DOCUMENTS,
"FR 2,717,041 9/1974" should read -- FR 2,217,041 09/1974 --

Signed and Sealed this
Fifth Day of April, 2016

Michelle K. Lee

Michelle K. Lee
*Director of the United States Patent and Trademark Office*